United States Patent [19]

Bettcher

[11] 4,166,317

[45] Sep. 4, 1979

[54] TRIMMING KNIFE

[75] Inventor: Louis A. Bettcher, Amherst, Ohio

[73] Assignee: Bettcher Industries, Inc., Birmingham, Ohio

[21] Appl. No.: 842,584

[22] Filed: Oct. 17, 1977

[51] Int. Cl.[2] ..... B26B 29/02

[52] U.S. Cl. ..... 30/276

[58] Field of Search ..... 30/43.4, 264, 276, 293, 30/286; 17/1 R, 1 G

[56] References Cited

U.S. PATENT DOCUMENTS

| | | | |
|---|---|---|---|
| 2,827,657 | 3/1958 | Bettcher | 30/264 X |
| 3,197,808 | 8/1965 | Mears | 17/1 G |
| 3,461,557 | 8/1969 | Behring | 30/276 |
| 3,688,403 | 9/1972 | Bettcher | 30/276 |

*Primary Examiner*—Jimmy C. Peters

*Attorney, Agent, or Firm*—Watts, Hoffmann, Fisher & Heinke & Co.

[57] ABSTRACT

A manually held and manipulated knife for trimming a comestible product such as meat having a frame or frame assembly including a hand grasp or handle part extending radially outwardly from a ring-like part of short axial length and of considerable greater diameter than its axial length, a power driven ring-like blade also of short axial length rotatably supported in the ring-like part of the handle and having a radially inwardly facing circular cutting edge at one axial end, and a ring-like depth of cut control or gauge member within the blade and connected to the frame assembly for adjustment lengthwise of the axis of the blade by screws located radially outwardly of the gauge member. Clearance is provided between the blade and the depth of cut control or gauge member which clearance increases in the direction away from the cutting edge of the blade. The part of the depth of cut control or gauge member spaced from its connection to the frame assembly is flexible and the gauge member is split adjacent to one side of the handle part. Screws are provided for flexing parts of the gauge member relative to other parts thereof and/or preventing flexing of the split end of the split gauge member in the axial direction away from the cutting edge of the blade.

4 Claims, 2 Drawing Figures

TRIMMING KNIFE

BACKGROUND OF THE INVENTION

1. Field of the Invention

The invention relates to manually manipulatable knives having power driven ring-like blades which knives are used for trimming comestible products; especially meat, principally in the packing house and meat distribution industries.

2. Description of the Prior Art

Manually manipulable knives having a power driven ring-like cutting blade and a depth of cut gauges are known but the capabilities of these prior knives are limited and are not entirely satisfactory for many operations such as, trimming fat, skin, membrane, or the like, from meat products, for example, hams. Knives of the character mentioned are disclosed in U.S. Pat. Nos. 3,461,557 and 3,688,403 which patents are believed to disclose the most pertinent prior art known to applicant.

Some additional patents in the art to which the present invention belongs are U.S. Pat. Nos. 2,827,657; 3,024,532; Re. 25,947; 3,269,010; 3,852,882 and some of the references cited therein including German Pat. No. 1,064,216.

The knife shown in U.S. Pat. No. 3,461,557 has a disk supported in the opening of an annular power driven blade supported in an annular part of the frame or body of the knife which includes a generally round handle extends in a radial direction. The handle lies generally in the plane of the annular ring-like blade. The disk is supported and adjusted axially of the blade by structure located within the circumference of the blade and extending a considerable distance axially of the blade and is purported to serve as a depth of cut control or gauge when the knife is moved over a work body with the plane of the knife blade inclined slightly upwardly therefrom. The periphery of the depth of cut control disk closes the opening through the annular or ring-like parts of the knife except for a small space about it periphery through which space a slice cut from the product being operated upon is perported to pass. The disk obviously obstructs the operatives view of the product where a slice is to be taken.

The mechanism for adjusting the depth of cut control or gauge member of the knife of U.S. Pat. No. 3,688,403 extends, as does, the corresponding mechanism shown in U.S. Pat. No. 3,461,557, a considerable distance axially above the blade and interfeers with the attractiveness of the knife and its use. The knife disclosed and claimed herein is of a more simplified design, has a better appearance, is more flexible in use and is otherwise considered a major improvement of the prior knive especially for certain trimming operations and it is believed that it will be well accepted in the packing house and other meat processing industries.

SUMMARY OF THE INVENTION

The invention provides a novel and improved manually manipulable knife comprising a frame or frame assembly including a handle projecting radially from a ring-like structure of short axial length which supports therein a power driven ring-like blade also of short axial length relative to its diameter having an annular cutting edge at one end, and a ring-like depth of cut control or gauge assembly within the knife blade connected to the frame assembly of the knife adjacent to the handle part by devices or structures located for the most part radially outwardly of the gauge member proper and within the dimensions of the knife axially of the blade. The gauge member proper, that is, the part of the gauge member spaced from its connection to the frame of the knife is flexible, at least, to a limited extent and is split at the left or right side of the part thereof attached to the handle part of the knife frame assembly depending upon whether the knife is to be used by a right hand person or a left hand person, respectively. The knife includes means for adjusting the flexible part of the gauge member proper in addition to means for adjusting the gauge assembly axially of the knife blade as a unit whereby an operative has complete control over the thickness of a slice being cut from a product by pressing the flexible part of the gauge member that is, the part spaced from the connection of the gauge assembly to the knife more or less hard against the product being trimmed and/or by manipulation of the aforesaid adjusting means.

The invention also provides a novel and improved flexible gauge of the character referred to for a manually manipulable knife comprising a handle extending radially from a ring-like structure supporting a power driven ring-like blade of short axial length having a cutting edge at one end by the use of which gauge the thickness of a cut made by the knife can be readily varied and controlled by the operator.

The invention resides in certain constructions and combination of parts and further objects and advantages of the invention will be hereinafter referred and/or will become apparent from the preferred embodiment shown in the accompanying drawing and hereinafter described.

DESCRIPTION OF THE PREFERRED EMBODIMENT

Figure 1:
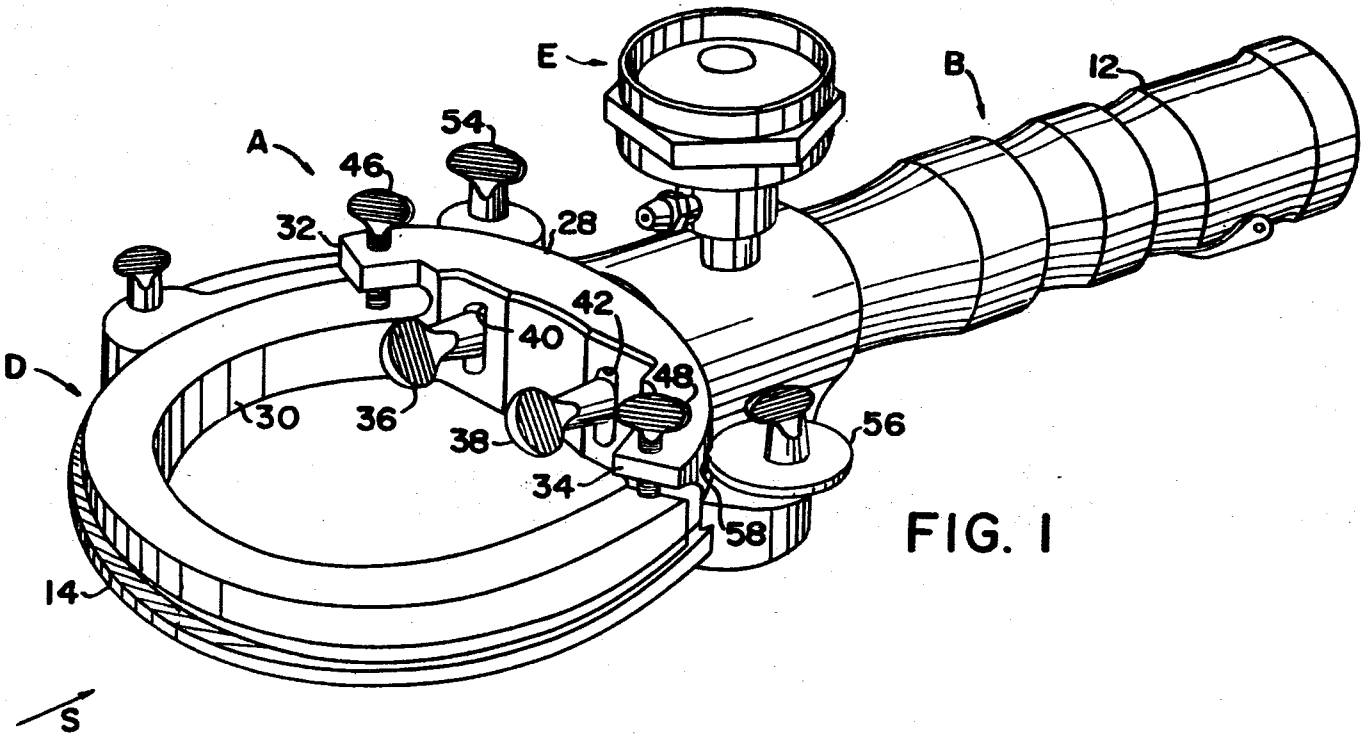
FIG. 1 is a prospective view of a knife embodying the present invention and representing the preferred embodiment of the invention.
Figure 2:
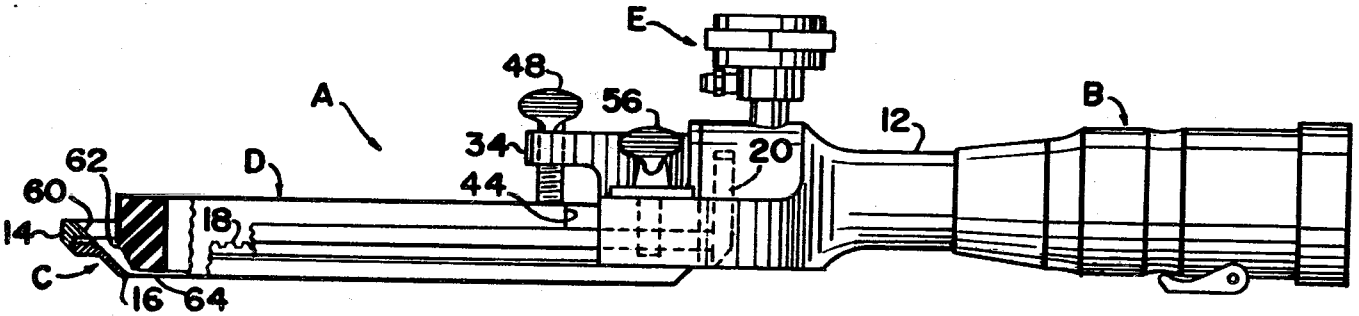
FIG. 2 is a side elevational view of the knife shown in FIG. 1 with parts in section approximately along the line 2—2 of FIG. 1.

The knife depicted in the drawing is designated generally by the reference character A and comprises a frame or frame assembly B having a tubular handle part 12 projecting radially outwardly from a ring-like part 14. A ring-like annular blade C is rotatably supported in the part 14 of the frame B. Both the part 14 of the frame B and the blade C are of short axial length compared to their diameters, preferably about 1 to 15, and the blade has a radially inwardly facing annular peripherial cutting edge 16 at one end which end extends a short distance below the part 14 of the frame B and within which frame the other end of the blade is rotatably supported. The end of the blade opposite its cutting edge is provided with annular gear teeth 18 by which the blade C is driven from a power actuated gear 20 in the handle part of the frame B in a known manner.

The parts of the depicted knife A thus far mentioned are similar to the corresponding parts of the knife disclosed in the aforesaid U.S. Pat. No. 3,688,403, the disclosure of which is incorporated herein by reference. The important differences between the knife disclosed in said U.S. Pat. No. 3,688,403 and the knife of the present invention are the depth of cut control or gauge members of the respective knives and the manner of their connections to the frame assemblies of the knives.

The knife A incorporates an annular tube-like depth of cut control or gauge member designated D. The depicted gauge D is of split ring configuration and comprises what is herein sometimes referred to as a base part 28 at one side connected to the frame B and a ring-like gauge proper or product contacting part 30 concretic with the blade C. The base part 28 of the gauge is of about twice the axial length of the gauge part 30 in the direction of the axis of the blade C, extends through an arc of about 30° to 40° and has short projections 32, 34 at opposite ends which overlay the adjacent parts or areas of the gauge part 30. The base part 28 of the gauge D is connected to the assembly B by two wing headed screws 36, 38 extending through two circumferentially spaced axially extending slots 40, 42 in the part 28 and threaded into tapped apertures in the handle part of the frame assembly B. The slots 40, 42 permit axial adjustment of the gauge D relative to the frame B.

The depicted knife is designed for right hand operatives and the blade C is rotated in a clockwise direction as viewed in FIG. 1. The part 30 of the gauge assembly D which is the part of the gauge that normally contacts the product being worked and constitute the gauge proper is flexible and separated from the base part 28 at the right hand end of the part 28 as viewed in FIG. 1 by a slight gap 44 so that it can readily flex relative thereto. The part 30 of the gauge D can be deflected downwardly as viewed in the drawing relative to the base part 28 and in turn relative to the frame B and the blade C by a wing headed screw 46 threaded into a tapped aperture in the projection 32 the lower end of which screw abuts the part 30 of the gauge therebeneath. This gives the operative control over the depth of cut being taken heretofore unatainable in devices of this character. Flexing of the free end of the part 30 of the gauge in an axial direction away from the cutting edge of the blade C can be limited or prevented by a wing headed screw 48 threaded into a tapped aperture in the projection 34 the lower end of which screw can be positioned to engage the free end of the part 30 therebelow upon predetermined flexing thereof or positioned in contact therewith to prevent flexing thereof, as desired. If it is not desired to limit and/or prevent flexing of the free end of the part 30 of the gauge assembly the screw 48 can be omitted. The gap 44 in the depicted gauge assembly is of sufficient size to permit the insertion of a sharpening steel or stone therethrough when an operative wishes to sharpen the blade C.

The axial position of the gauge part 30, where the cut is to be taken, relative to the cutting edge of the blade C, can be changed slightly without changing the axial position of the gauge D as a whole by manipulation of the screw 56. In trimming a comestible product, such as, a ham, a right handed operative typically moves the knife from left to right or in the direction of the free end of the handle of the knife or in the general direction indicated by the arrow S in FIG. 1 and, because of the flexibility of the part 30 and the adjustment provided by the screw 46 the operative by pressing the free end of the knife harder or less hard on the product being trimmed has precise control over the thickness of the slice cut or trimmed from the product. If the operative wishes to limit or prevent flexing of the free end of the part 30, that is, the part adjacent to the gap 44, the end of the screw 48 can be moved to or from the part 30 therebeneath or into engagement with the part 30 therebelow. When the screw 48 is moved into engagement with the part 30, this in effect produces a solid or non split gauge.

The part of the depicted knife A designated by the reference character E is merely a conventional device for periodically lubricating the driving gearing for the blade. The metal parts of the apparatus for the most part are made of caroosive resistant steel and the gauge assembly D is preferably made of a suitable nontoxic or ebidle plastic which has the necessary flexibility, for example, a high density polyethylene or Nylon. The use of such a plastic is particularly advantageous as they are nonporous, will not absorb bacteria, are highly resistant to acids and alkalines, have a clean appearance, become white with age, have low coefficients of friction, and are easily cleaned.

In the depicted knife the gauge D can be moved axially of the blade C by two flanged screws 54, 56 located radially outwardly of the gauge and threaded into suitably tapped apertures in parts of the handle assembly extending to the right and left a short distance circumferentially of the blade C. The flanges of the screws 54, 56 project into slots 58 in the base part 28 of the gauge member D. Prior to adjusting the gauge D towards or from the cutting edge 16 of the blade C the screws 36, 38 are preferably loosened and after the adjustment is made the screws 36, 38 can be again tightened.

The inside surface 60 of the knife blade C which surface is preferably conical preferably makes an angle of about thirty degrees (30°) to about forty five degrees (45°) with the plane of the cutting edge 16 and the radially outer surface 62 of the part 30 of the gauge assembly D adjacent to the cutting edge of the blade and which is also conical makes an angle of about fifty degrees (50°) to seventy degrees (70°) preferably about sixty degrees (60°) with the plane of the cutting of the blade or the end surface 64 of the gauge member nearest the cutting edge which surface is also planar. The gap provided between the adjacent surfaces 60 of the knife blade C and 62 of the part 30 of the gauge assembly D diverge in the direction away from the cutting edge 16 of the blade by an angle of from about ten degrees (10°) to about thirty degrees (30°) to allow a slice trimmed from a product to pass freely upwardly between the blade and the gauge member. The angles mentioned above are merely representative of angles which may possibly employed which angles may vary for different knives depending upon the diameters of the blades employed, the type of product being operated upon the surface of the gauge member D adjacent to the cutting edge 16 of the blade C is normally planar and parallel with the plane of the cutting edge 16. This results in a sharp or distinct corner at the edge of the gauge member adjacent to the cutting edge of the blade which construction is an improvement over the rounded construction of the prior art.

From the foregoing description of the depicted knife and suggested modifications of the construction of the knife illustrated it will be apparent that the objects heretofore mentioned and others have been accomplished and that there has been provided a novel and improved depth of cut gauge and knife of the character referred to incorporating such a gauge which provides the operative with maximum control over the thickness of a slice of material being trimmed from a comistable product, such as, meat.

While the preferred embodiment of the invention have been illustrated and described in considerable detail the depicted knive is merely illustrative of the invention and may be modified in many ways within the scope of the invention. The cross sectional shape of the knife and/or the product contacting part of gauge assembly, for examples, may be varied as desired and various power sources may be employed to drive the knife blade, etc.

It is the intention to hereby cover all adaptations modifications and uses of the depicted knife which come with the skill of those to which the invention relates and the scope of the following claims.

What is claimed is:

1. A gauge for a hand-held and manipulated knife for trimming a comistable product, such as, meat, and having a handle projecting radially from an annular ring-like member of short axial length in which a ring-like blade of short axial length having an annular cutting edge at one end is rotatably supported and power driven, said gauge assembly comprising an annular member having a base part adapted for connection to the knife and a flexible ring-like gauge part proper integral with said base part but separated therefrom at one end and when the gauge assembly is connected to the knife concentric with the blade of the knife and conforming generally to the interior of the blade with a space between said gauge assembly and the blade of the knife, and means for adjusting said base part of said gauge assembly axially of the blade of the knife to which said gauge assembly is connected.

2. A device as claimed in claim 1 in which the base part of the gauge assembly has a threaded fastener the end of which overlies the free end of the flexible ring-like gauge part of the gauge assembly, which fastener is positionable to prevent flexing of the free end of the flexible ring-like gauge part in the direction away from the cutting edge of the blade of the knife.

3. A hand-held and manipulated knife for trimming a comistable product, such as, meat, and having a frame assembly including a handle projecting radially from an annular member of short axial length in which a ring-like blade of short axial length having an annular cutting edge at one end is rotatably supported and power driven, a gauge assembly comprising ring-like member having base part connected to said frame assembly of said knife and a flexible ring-like gauge part proper integral with said base part but separated therefrom at one end and concentric with and comforming generally to the interior of said blade with a space between said flexible ring-like gauge part and said blade means for axially adjusting said ring-like gauge part relative to said base part, and means for adjusting said base part of said gauge assembly axially of the knife blade.

4. A device as claimed in claim 3 in which the base part of the gauge assembly has a threaded fastener the end of which overlies the free end of the flexible ring-like gauge part of the gauge assembly, which fastener is positionable to prevent flexing of the free end of the flexible ring-like gauge part in the direction away from the cutting edge of the blade.

* * * * *